US005549972A

United States Patent [19]

Hsu et al.

[11] Patent Number: 5,549,972

[45] Date of Patent: Aug. 27, 1996

[54] SILVER-PLATED FIBERS OF POLY(P-PHENYLENE TEREPHTHALAMIDE) AND A PROCESS FOR MAKING THEM

[75] Inventors: Che-Hsiung Hsu; Wilfred Sweeny, both of Wilmington, Del.

[73] Assignee: E. I. Du Pont de Nemours & Company, Wilmington, Del.

[21] Appl. No.: 436,849

[22] Filed: May 8, 1995

Related U.S. Application Data

[62] Division of Ser. No. 194,594, Feb. 10, 1994, abandoned.

[51] Int. Cl.[6] ..... D06M 101/36

[52] U.S. Cl. ..... 428/398; 428/373; 428/379; 428/389; 428/395; 428/396

[58] Field of Search ..... 428/364, 373, 428/374, 375, 389, 395, 396, 378

[56] References Cited

U.S. PATENT DOCUMENTS

| | | | |
|---|---|---|---|
| 4,604,427 | 8/1986 | Roberts et al. | 428/394 |
| 4,614,684 | 9/1986 | Ebneth et al. | 428/252 |
| 4,681,820 | 7/1987 | Tomibe et al. | 428/395 |
| 4,804,475 | 2/1989 | Sirinyan et al. | 210/651 |
| 5,182,067 | 1/1993 | Chiou | 264/184 |
| 5,302,415 | 4/1994 | Gabara et al. | 427/306 |
| 5,370,934 | 12/1994 | Burch et al. | 428/378 |
| 5,399,382 | 3/1995 | Burch et al. | 427/306 |
| 5,411,795 | 5/1995 | Silverman | 428/389 |
| 5,422,142 | 6/1995 | Hsu | 427/306 |

*Primary Examiner*—N. Edwards
*Assistant Examiner*—J. M. Gray

[57] ABSTRACT

Silver-plated aramid fibers are disclosed having a core of sulfonated aramid, an outer layer of continuous silver, and a zone of impregnation therebetween made up of domains of silver metal dispersed in a matrix of sulfonated aramid; and a process for making such fibers.

2 Claims, 2 Drawing Sheets

SILVER-PLATED FIBERS OF POLY(P-PHENYLENE TEREPHTHALAMIDE) AND A PROCESS FOR MAKING THEM

This is a division of application Ser. No. 08/194,594, filed Feb. 10, 1994, now abandoned.

BACKGROUND OF THE INVENTION

1. Field of the Invention

This invention relates to a process for making silver-plated fibers of poly(p-phenylene terephthalamide) (PPD-T) wherein the silver plating exhibits very strong adhesion to the fiber core, and to the fibers so-made.

2. Description of the Prior Art

U.S. Pat. No. 5,302,415, issued on Apr. 12, 1994 discloses treatment of aramid fibers in concentrated sulfuric acid to increase adhesion of metal electrolessly plated thereon. The aramid fibers are dried prior to the treatment and plating processes.

Japanese Unexamined Patent Application (Kokai) No. 3-120043, published May 22, 1991, discloses plating aramid film in a wet, isotropic state. Isotropicity is required and is achieved by humidification of cast films prior to plating.

SUMMARY OF THE INVENTION

The present invention provides a process for making silver-plated PPD-T fibers wherein the silver is serongly adherent to the fiber by virtue of having a zone of impregnation of silver comingled With the fiber between the body of the fiber and the silver plating layer, comprising the steps of: (a) spinning an anisotropic solution of PPD-T having a sulfur content greater than 0.5 weight percent based on the total weight of the PPD-T into an aqueous coagulating bath to yield coagulated fibers; (b) transporting the coagulated fibers through the coagulating bath to yield never-dried fibers having 20 to 120 weight percent water, based on total weight of the PPD-T; (c) plating the never-dried fibers in an electroless silver plating bath. The plating step includes introducing the never-dried fibers into an aqueous stannous ion solution to sensitize the PPD-T of the fibers; rinsing the sensitized PPD-T of the fibers; immersing the rinsed fibers in an aqueous solution of silver ions; and adding a reducing agent to the aqueous solution of silver ions to cause a deposition of metallic silver onto the fibers.

The invention also provides such a process wherein the plating is conducted on fibers of PPD-T having less than 20 weight percent water and greater than 0.5 weight percent sulfur based on the total weight of the PPD-T.

The present invention also provides fibers having a core of sulfonated PPD-T, an outer layer of a continuous coating of silver, and a zone of impregnation between the core and the outer layer, 0.01 to 3 micrometers thick; and is especially concerned with such fibers wherein the PPD-T has a sulfur content of greater than 0.5 weight percent based on the total weight of the PPD-T.

DETAILED DESCRIPTION OF THE INVENTION

Figure 1:
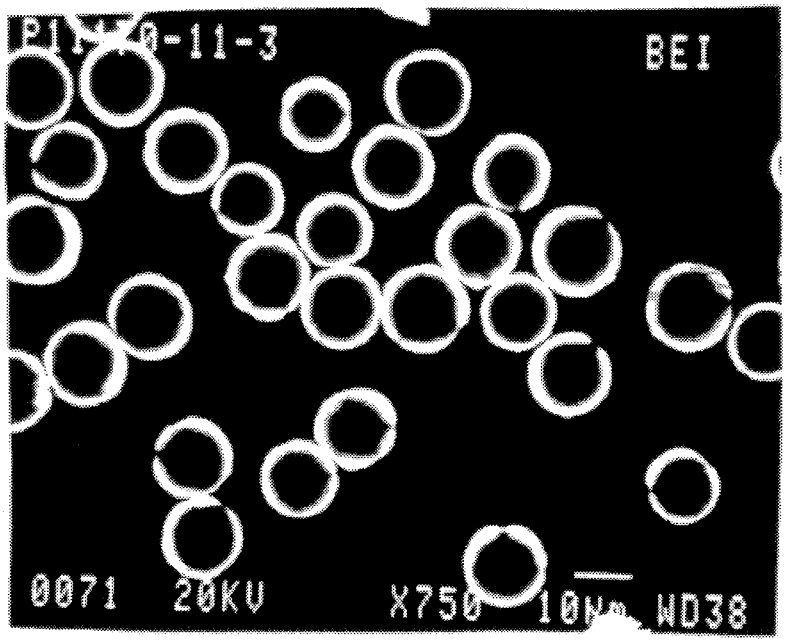
FIGS. 1 and 3 are cross sectional photomicrographs of fibers of the present invention wherein plating is conducted on PPD-T having at least 0.5 weight percent sulfur

The present invention is concerned specifically with PPD-T fibers having a strongly adherent silver coating. The coating is applied by an electroless process and the strong adhesion of the silver coating is accomplished by the presence of at least 0.5 weight percent sulfur in the PPD-T of the fiber. In a preferred embodiment of the invention, there is a combination of two conditions present in the manufacturing process. It has been discovered that the adherent plating can be accomplished by conducting the plating on PPD-T which has been sulfonated to a level of at least 0.5 and, preferably, 0.7 weight percent sulfur; and, in a preferred embodiment, by using never-dried PPD-T fibers as the plating substrate.

By poly(p-phenylene terephthalamide) (PPD-T) is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that other diamines and diacid chlorides have no reactive groups which interfere with the polymerization reaction. PPD-T, also, means copolymers resulting from incorporation of other aromatic diamines and other aromatic diacid chlorides, such as, for example, 2,6-naphthaloylchloride or chloro- or dichloroterephthaloyl chloride; provided, only that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414.

Additives can be used with the PPD-T and it has been found that up to as much as 10 percent, by weight, of other polymeric material can be blended with the PPD-T or that copolymers can be used having as much as 10 percent of other diamine substituted for the diamine of the PPD-T or as much as 10 percent of other diacid chloride substituted for the diacid chloride of the PPD-T.

Up to this time, in order to have an electrolessly plated metal coating which was strongly adherent, it was believed that the PPD-T fiber surfaces had to be chemically treated to generate sites of activation for the plating process. In accordance with this invention, however, it has been discovered that the PPD-T can be sulfonated at any time prior to or during formation of the fibers and no additional chemical treatment is necessary before plating.

It is believed that sulfonation provides an enduring activation of the PPD-T for plating processes. Individual sulfonation sites are believed to serve as activated sites for plating and those sites are present throughout the PPD-T rather than only on the surface. Moreover, sulfonation sites remain activated sites through additional processing of the PPD-T; and are not deactivated by contact with water or acid or other reactive materials as happens with plating activators of the prior art.

It is believed that any degree of sulfonation will improve the plating adhesion of silver; but that, below about 0.5 weight percent sulfur, based on the weight of the PPD-T, the improvement is difficult to measure. It has been difficult to sulfonate PPD-T to much above 3 weight percent sulfur without causing severe degradation of the polymer. For those reasons of practicality, it is preferred, at this time, that the-PPD-T used in practice of this invention should have a sulfur content of 0.5 to 3 weight percent, based on the total weight of the polymer.

In the practice of this invention, sulfonation of the PPD-T can be accomplished by treatment with fuming sulfuric acid of a particular concentration to cause sulfonation of the PPD-T molecules. Conditions are carefully controlled, such that the PPD-T degradation is minimized while, at the same time, achieving the desired degree of sulfonation. The PPD-T to be sulfonated generally is selected to have a high inherent viscosity before sulfonation and retains a high inherent viscosity after sulfonation.

The sulfuric acid used for sulfonation is preferably more than 100% sulfuric acid; but cannot be so high that it will cause undue degradation of the PPD-T. The degree of sulfonation and the degree of degradation form a balance which is controlled by the sulfuric acid concentration, the time of exposure of PPD-T to that acid, and the temperature of the acid during exposure. sulfonation of PPD-T is disclosed in U.S. Pat. No. 5,182,067, issued Jan. 26, 1994. At temperatures below about 60° C., there is virtually no sulfonation. Sulfuric acid of concentrations above about 103% cause unacceptably severe degradation of PPD-T compared with the degree of sulfonation at any reasonable temperature for any time. PPD-T is sulfonated and is not unacceptably degraded by exposure to sulfuric acid of concentrations from. 100.5 to 102.5% at temperatures of 70° to 80° C. for periods of 1 to 3 hours.

In preparation of fibers by spinning from solutions of PPD-T, the solvent for the PPD-T is sulfuric acid. The spinning solution of PPD-T is made by dissolving the PPD-T at the desired concentration in sulfuric acid of a concentration of at least 98%. The PPD-T must be in such a concentration that an anisotropic solution is formed of PPD-T in the sulfuric acid. The concentration of PPD-T for practice of this invention is, generally, 17 to about 20 weight percent. The PPD-T which is dissolved in the sulfuric acid can be previously sulfonated or it can be dissolved with the intention of sulfonating it at the same time as it is dissolved. spinning solutions can be made using sulfuric acid of the concentration necessary for the sulfonation of this invention; and the sulfonation temperature and time ranges for sulfonation are, also, compatible with preparation and use of spinning solutions.

The sulfonation conditions of the present invention result in sulfur levels of about 0.5 to 3%, by weight, as bound sulfonic acid or sulfonate groups on the PPD-T. It has been concluded that a sulfur level of less than 0.5% may give rise to the improvement of this invention; but that the improvement is not great and, from a practical matter, is difficult to measure. A practical upper limit for sulfur content in PPD-T fibers has been set at about 3%.

PPD-T fibers of this invention are made by spinning a solution of the sulfonated PPD-T into an aqueous coagulating bath to yield filaments of coagulated PPD-T and then performing the electroless plating on those filaments before all of the water has been removed. Those coagulated filaments are termed "never-dried" fibers and use of such never-dried fibers is preferable in practice of this invention. Never-dried fibers may contain from 20 to as much as 120, or more, weight percent water and have never been dried to less than 20 weight percent water.

Fibers which have-been dried to a water content of less than 20 can, also, be plated in accordance with this invention provided only that the PPD-T has been sulfonated to the required levels. While the plating on such dried fibers of sulfonated PPD-T may exhibit less conductivity than equivalent plating applied to never-dried fibers, that conductivity has been found to be much higher than plating applied to PPD-T fibers having a sulfur content less than 0.5%, whether dried or never-dried.

By using never-dried PPD-T fibers along with sulfonated PPD-T, in practice of this invention, plating solutions can penetrate into the fiber and come into direct contact with more sites of sulfonation on the PPD-T. Thus, the preferred combination of sulfonation before formation of the fibers and the use of never-dried fibers to expose a below-the-surface portion of the fibers to the plating solution, has been discovered to yield fibers having a core of PPD-T, a continuous outer layer of silver metal coating, and a "zone of impregnation" between the core and the outer layer in which silver domains are dispersed within a matrix of the PPD-T.

While the zone of impregnation is a result of impregnation of the swollen, never-dried, PPD-T fiber by the plating solution followed by conversion of the silver cations in the plating solution to silver metal, there is, also, a zone of impregnation which results from plating dried fibers of sulfonated PPD-T, although, when using dried fibers, the zone is substantially attenuated. Sulfonation sites on the PPD-T are believed to provide anchors for the formation of silver domains in the plating process; and, in the presence of a surplus of such sites, the concentration of plated silver domains is a function of the concentration of the plating solution in and around the PPD-T fibers. While the concentration of the plating solution in the fibers is a function of the time of impregnation, the rate of impregnation is somewhat self-limiting because, as impregnation occurs, so, also, is the silver from the plating solution reduced to metal, thereby, slowing further impregnation.

The silver domains in the zone of impregnation are somewhat interconnected and, to some extent, serve as "roots" to anchor the continuous silver outer layer which is ultimately formed as a coating on the fibers. The thickness of the zone of impregnation is from 0.01 to 3 micrometers and depends somewhat on conditions under which the process is conducted, such as, for example, temperature of the solutions, water content of the fibers, and the like.

Figure 3:
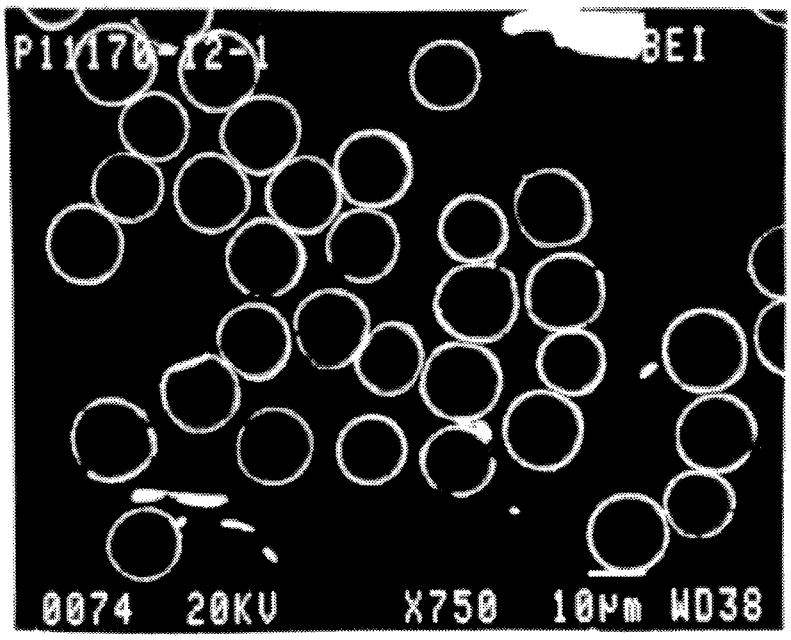

FIGS. 1 and 3 are scanning electron microscopy (SEM) photographs of cross-sections of plated fibers of this invention as prepared in Examples 1 and 2, hereinafter.

Figure 2:
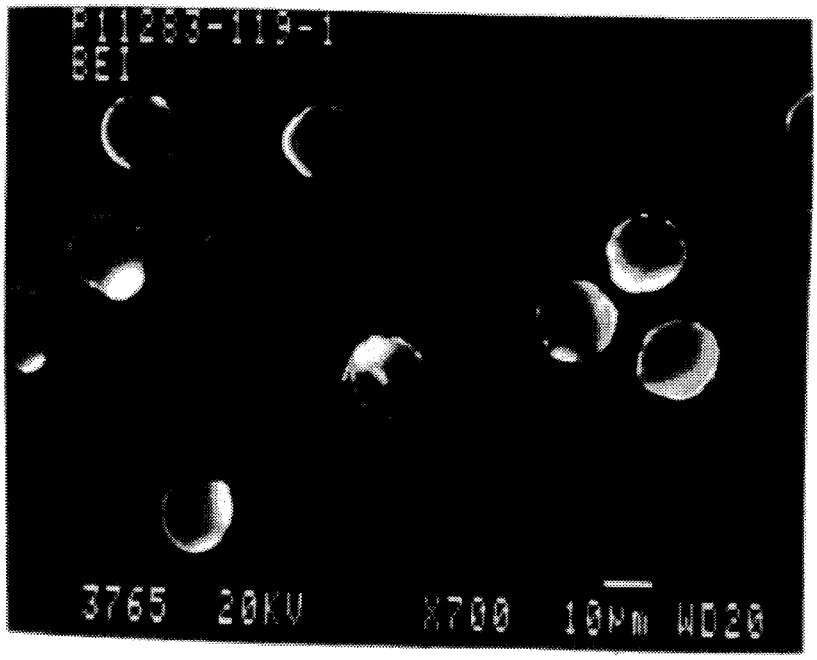
FIG. 2 (PRIOR ART)
FIGS. 2 and 4 are cross sectional photomicrographs of fibers of the prior art wherein the plating is conducted on fibers with less than 0.5 weight percent sulfur on the PPD-T.
Figure 4:
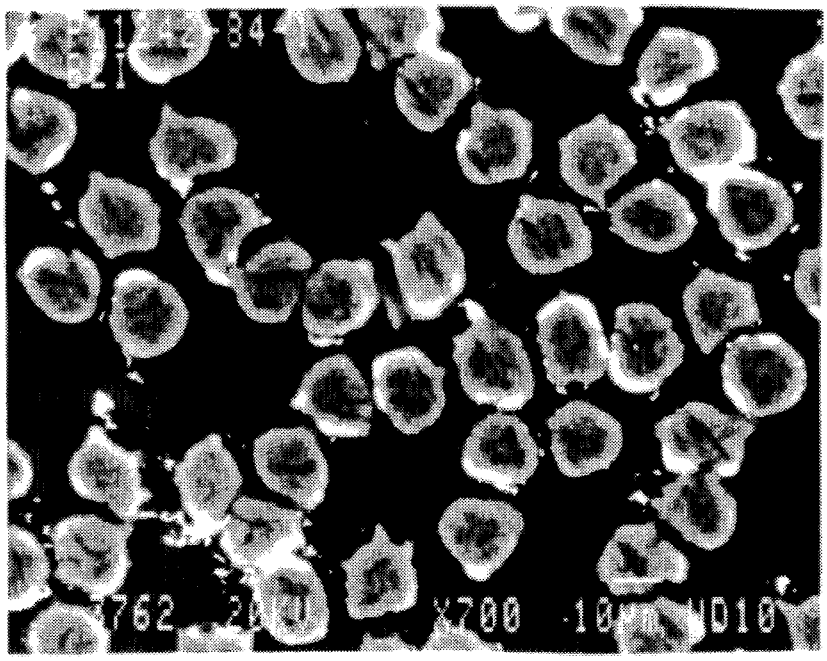
FIG.4 (PRIOR ART)

FIGS. 2 and 4 are SEM photographs of cross-sections of plated comparison fibers as described in Examples 1 and 2, hereinafter.

FIG. 1 is a X750 magnification of never-dried PPD-T fibers having 0.83% sulfur and plated by silver as described in Example 1. FIG. 2 is a X700 magnification of never-dried PPD-T fibers having only 0.29% sulfur and plated as the comparison described in Example 1.

FIG. 3 is a X750 magnification of dried PPD-T fibers having a moisture content of less than 10 weight percent, 0.83% sulfur, and plated by silver as described in Example 2. FIG. 4 is a X700 magnification of dried PPD-T fibers having a moisture content of less than 10 weight percent, only 0.29% sulfur, and plated as the comparison described in Example 2.

The silver outer layer can be of any thickness. It is preferred that the outer layer be at least thick enough to form a continuous silver metal coating. Because the silver is generally present for the purpose of increasing electrical conductivity, the coating should be adequate to meet the electrical needs of the moment. It has often been the case that the finished silver-plated PPD-T fiber product is from 5 to 55 weight percent silver, based on the total weight of the plated fiber. As a matter of practicality, the thickness of the plated metal should be from 0.01 to 3 micrometer.

One of the surprising features of this invention resides in the discovery that the continuity of the outer layer of plated silver metal is maintained through drying of the never-dried fibers even though the fibers may undergo substantial shrinkage during the course of the drying.

This invention is directed toward electroless plating of silver and any of the known electroless silver plating systems can be used. Using the sulfonated, never-dried, PPD-T fibers of this invention, any electroless silver plating system will yield plated metallic silver exhibiting greater plated silver adhesion than would be exhibited with the same plating system using PPD-T fibers which were either low in sulfonation or dried or both.

TEST METHODS

Electrical resistance:

Electrical resistance of silver-plated fiber is determined as follows: A fiber sample is attached to two pressure-contact probes spaced one centimeter apart. The two probes are then connected to a Keithley electrometer for determination of resistance; and the resistance is reported as ohms per centimeter.

Tensile Test:

Tenacity/Elongation/Modulus (T/E/Mi) of yarn at a inch gauge length are reported in grams per denier for T and Mi and in % for E. The tensile test is conducted according to ASTM 2101. Yarn denier is determined by weighing a sample 90 cm long and multiplying the weight in grams by 10,000.

Sulfur Element Analysis:

A yarn sample of small quantity (about 0.5 gram) is dissolved in about 96% sulfuric acid and water is then added to precipitate the polymer. Water is continuously added, thereafter, to thoroughly wash the polymer to remove any free sulfate, such as sodium sulfate, from the polymer. The resulting polymer sample is further dried and carefully weighed before being placed in a Schoniger flask for combustion with pure oxygen. $SO_2$ and $SO_3$ generated by the combustion are absorbed in water to form sulfuric acid. The acid is titrated using barium chloride to determine the sulfur content, as bound sulfonic acid or sulfonate groups, of the original yarn sample.

Inherent viscosity:

Inherent viscosity (IV) is defined by the equation:

$$IV = 1n\ (\text{relative viscosity})/C$$

where C is the concentration (0.05 gram of polymer in 10 ml 96 W. % sulfuric acid) of the polymer solution and relative viscosity is the ratio between the flow times of the polymer solution and the solvent as measured at 30° C. in a capillary viscometer.

DESCRIPTION OF THE PREFERRED EMBODIMENTS

EXAMPLE 1

Spinning fibers of sulfonated PPD-T

PPD-T having 6.3 dl/g inherent viscosity was mixed with 100.5 W. % sulfuric acid, prechilled to about 15° C., at 19.0 W. % solid. The mixture was stirred slowly at that temperature for about 15 minutes and then at 80° C. for two hours to form a solution. The solution was kept at 70° C. to 80° C. with constant stirring for 21 hours to further sulfonate the PPD-T.

The solution, maintained at 73° C. in a spin cell, was extruded through a 10-hole spinneret, kept at 70° C., at a spin stretch factor of 6.8, through an air gap of 0.5 cm, and into a water coagulation bath kept at 5°–10° C. The 10-filament yarn was wound-up on a bobbin constantly sprayed with water. The as-spun yarn was then soaked in an aqueous sodium bicarbonate solution for one hour followed by extensive washing with water. The wet yarn was immersed in a dilute aqueous HCl solution for about 12 hours followed by extensive washing with water. The yarn was stored in water and was about 100–120 W. % water, based on weight of dried yarn. A small portion of the as-spun yarn stored in water was thoroughly dried and measured for tensile properties and sulfur content. The dried yarn had T/E/M (5 inch gauge length) of 22.3 gpd/3.9 % 463 gpd, respectively, inherent viscosity of 5.1, and sulfur content of 0.83 W. %.

As a comparison example, fibers were spun using the same PPD-T polymer mixed with sulfuric acid at the same concentration and using the same spinning procedure as described herein except that PPD-T with very little Sulfonation was used. The spin dope was made using 100.1 W. % sulfuric acid and the spinning process and conditions were, otherwise, the-same as in the previous example. A small portion of the fibers from-this comparison example was dried and measured for tensile properties and sulfur content. The dried yarn had T/E/M of 22.1 gpd/3.7%/513 gpd, respectively, and sulfur content of 0.29 W. %.

Plating never-dried fibers

About 0.1 gram each of the "never-dried" sulfonated PPD-T fiber of this invention and the "never-dried" low sulfonated PPD-T fiber of the comparison example were back wound to form loops 4 cm in diameter. The loops were then tied together to form "8" shaped bundles. The bundles, while still wet, were immersed for 15 minutes in solutions containing 60 g deionized water, 1.5 g anhydrous stannous chloride and 4 ml of concentrated hydrochloric acid. The treated bundles were then immersed in three changes of deionized water for two minutes each. The thoroughly washed fiber bundles were then immersed, at about 5° C. for 15 minutes in a solution containing 250 g deionized water, 2 g silver nitrate, about 2 ml of 30 W. % ammonium hydroxide, and 1 ml Stepanol@ AEM, a wetting agent, sold by Stepan Company, Northfield, Ill., U.S.A.

When the bundles came into contact with the silver nitrate solution, the fibers turned very dark, indicating that silver ions were reduced by tin (+2) to form high concentration of activation sites for subsequent silver electroless plating. At the end of the 15 minutes, 2 ml of aqueous 38 W. % formaldehyde were added to carry out silver electroless plating. The plating was allowed to proceed for 35 minutes with periodic stirring of the plating solution. Each of the fiber bundles became metallic in appearance. They were washed thoroughly with water and then dried.

A small section cut from the 20 filament bundle of plated, never-dried sulfonated fibers exhibited an electrical resistance of 8.8 ohm/cm. Four filaments taken out individually from the 20 filament bundle exhibited electrical resistance of 0.17, 0.18, 0.19, and 0.12 kilo-ohm/cm. The single filament resistances were quite consistent with the resistance of the 20 filament bundle, indicating that each filament was homogeneously plated. FIG. 1 is a scanning electron microscopy (SEM) photograph of a cross section of the plated fiber of this invention showing that silver deposits both on the filament surface and in a zone of impregnation about 1 micron deep beneath the surface of the filament. The incorporation of silver inside the fiber is an important characteristic for silver adhesion to the fiber.

FIG. 2 of a SEM photograph of a cross-section of the plated, never-dried, low sulfonation comparison fibers of this example which were tested in the same way and individual filaments were found to exhibit electrical resistance of 50, 35, 40, and 3600 kilo-ohms/cm.

Thermal gravimetric analysis (20° C. scan rate in air) showed that fibers reached a constant weight above 480° C. and still had 53 W. % as a residue, showing that the plated, sulfonated, fiber contained about 53 W. % silver. The low unsulfonation comparison fibers were shown, by the same method, to have 23 W. % silver.

The plating procedure was repeated using the same "never-dried" sulfonated PPD-T fibers but using only 25 and 15 minutes for plating in respective tests. The amount of silver which was plated was slightly reduced with reduction in time and the individual filament resistance was increased slightly with reduction in time; but, overall, it is clear that sulfonated PPD-T is effectively plated by this process.

Results are summarized in the Table.

EXAMPLE 2

Plating dried fibers

About 0.1 gram each of the "never-dried" sulfonated PPD-T fibers and the "never-dried" low sulfonation PPD-T comparison fibers of Example 1, containing about 100 W. % water, based on dry fiber weight, were formed into "8" shaped fiber bundles which were dried in air for five hours. The dried fiber bundles were then subjected to the silver-plating procedure described in Example 1. The fibers were washed thoroughly with water and then air-dried. The sulfonated fibers had a metallic luster and thermal gravimetric analysis (TGA) showed that those fibers had 9.3 W. % as a residue above 480° C. indicating that the sulfonated fibers contained about 9.3 W. % silver. The low sulfonation comparison fibers did not develop a metallic luster during the plating process and the fibers did not exhibit any weight gain as a result of the plating, indicating that the low sulfonation fibers contained no silver.

A small section of 31 filaments cut from the bundle of sulfonated fibers exhibited an electrical resistance of 46 ohm/cm. Three filaments taken out individually from the 31 filament section exhibited electrical resistance of 1.0, 1.2, and 1.3 kilo-ohm/cm. The single filament resistances were quite consistent with the resistance of the bundle, indicating that each filament was homogeneously plated with silver. FIG. 3 is a SEM photograph of a cross section of the plated fiber of this invention showing that silver was predominately deposited on the surface of the sulfonated fibers although there was a thin zone of impregnation by the silver into the sulfonated PPD-T at the surface of the fibers. FIG. 4 is a SEM photograph of a cross-section of the low sulfonation comparison fibers of this example showing a complete lack of plating. Electrical resistance of individual filaments of the unsulfonated PPD-T was greater than $10^5$ kilo-ohms/cm.

Results are summarized in the Table.

From these examples, it can be seen that sulfonated PPD-T is much more readily plated than low sulfonation PPD-T, whether in the "never-dried" form or not.

TABLE

| Exam. | Fiber | Plating Time (min) | Silver Content (W. %) | Filament Resistance (k-ohms/cm) | Sulfur Content (W. %) |
|---|---|---|---|---|---|
| 1-A | sulfonated/ never-dried | 35 | 53 | 0.1, 0.1, 0.2, 0.2 | 0.83 |
| 1-B | sulfonated/ never-dried | 25 | 49 | 0.3, 0.3, 0.2, 0.2 | 0.83 |
| 1-C | sulfonated/ never-dried | 15 | 48 | 0.5, 0.6, 0.8, 1.2 | 0.83 |
| 1-Comp. | low-sulf./ never-dried | 35 | 23 | 50, 35, 40, 3600 | 0.29 |
| 2 | sulfonated/ dried | 35 | 9.3 | 1.0, 1.1, 1.2, 1.3 | 0.83 |
| 2-Comp. | low-sulf./ dried | 35 | 0 | greater than $10^5$ | 0.29 |

We claim:

1. Fibers having a core of PPD-T with a sulfur content of greater than 0.5 weight percent based on the total weight of the PPD-T, an outer layer of a continuous coating of silver, and a zone of impregnation between the core and the outer layer, 0.01 to 3 micrometers thick.

2. The fibers of claim 1 wherein the PPD-T has a sulfur content of greater than 0.7 weight percent based on the total weight of the PPD-T.

* * * * *